US009371704B2

(12) United States Patent
Boekholtz et al.

(10) Patent No.: US 9,371,704 B2
(45) Date of Patent: Jun. 21, 2016

(54) JACKING UNITS AND BELLOWS FOR DOWN HOLE INTERVENTION TOOLS

(75) Inventors: Edo Boekholtz, Copenhagen K (DK); Ulger Gokhan, Gelsenkirchen (DE); Klaus Wahrmann, Gelsenkirchen (DE)

(73) Assignee: MAERSK OLIE OG GAS A/S, Copenhagen K (DK)

( * ) Notice: Subject to any disclaimer, the term of this patent is extended or adjusted under 35 U.S.C. 154(b) by 917 days.

(21) Appl. No.: 13/509,516

(22) PCT Filed: Nov. 9, 2010

(86) PCT No.: PCT/EP2010/067130
§ 371 (c)(1),
(2), (4) Date: Jul. 20, 2012

(87) PCT Pub. No.: WO2011/058015
PCT Pub. Date: May 19, 2011

(65) Prior Publication Data

US 2012/0273238 A1 Nov. 1, 2012

Related U.S. Application Data

(60) Provisional application No. 61/261,095, filed on Nov. 13, 2009.

(30) Foreign Application Priority Data

Nov. 13, 2009 (DK) ..... 2009 70205

(51) Int. Cl.
*E21B 23/01* (2006.01)
*E21B 17/10* (2006.01)
(Continued)

(52) U.S. Cl.
CPC ..... *E21B 17/1014* (2013.01); *E21B 7/04* (2013.01); *E21B 23/01* (2013.01); *E21B 43/112* (2013.01); *E21B 43/119* (2013.01)

(58) Field of Classification Search
CPC ..... E21B 7/046; E21B 10/60; E21B 17/1014; E21B 23/01; E21B 23/06; E21B 29/06; E21B 33/1243; E21B 33/1295; E21B 43/112
See application file for complete search history.

(56) References Cited

U.S. PATENT DOCUMENTS 2,942,666 A 6/1960 True et al.
3,294,170 A * 12/1966 Warren et al. ..... 166/100
(Continued)

FOREIGN PATENT DOCUMENTS

EP 0791723 A1 8/1997
GB 2433760 A 7/2007

OTHER PUBLICATIONS

Search Report for Application No. PA 2009 70205 dated Jun. 22, 2010.
(Continued)

*Primary Examiner* — Cathleen Hutchins
(74) *Attorney, Agent, or Firm* — Brinks Gilson & Lione

(57) ABSTRACT

A device and a method for positioning a tool in a well tubular. The device comprising a housing having jacking arm assemblies with extendable jacking arms for fixating the device inside the well tubular. The device further comprising a tool connected to the housing and bellow assemblies comprising inflatable means for positioning the device substantially in the center of the well tubular. By deflating the inflatable means and simultaneously activating the jacking arms the device is pushed in a direction which is substantially perpendicular to the well tubular.

16 Claims, 7 Drawing Sheets

(51) Int. Cl.

| | |
|---|---|
| ***E21B 7/04*** | (2006.01) |
| ***E21B 43/112*** | (2006.01) |
| ***E21B 43/119*** | (2006.01) |

(56) References Cited

U.S. PATENT DOCUMENTS

| | | | | |
|---|---|---|---|---|
| 3,595,326 | A * | 7/1971 | Claycomb | 175/73 |
| 5,105,881 | A | 4/1992 | Thoms | |
| 5,777,257 | A | 7/1998 | Kenny | |
| 6,209,636 | B1 * | 4/2001 | Roberts et al. | 166/117.6 |
| 6,581,455 | B1 * | 6/2003 | Berger et al. | 73/152.55 |
| 6,772,839 | B1 | 8/2004 | Bond | |
| 7,558,716 | B2 * | 7/2009 | Hammond | 703/10 |
| 2007/0256827 | A1 | 11/2007 | Guerrero | |

OTHER PUBLICATIONS

International-Type Search Report for Application No. DK 200970205 dated Jun. 30, 2010.

* cited by examiner

A - A

A - A

A - A

JACKING UNITS AND BELLOWS FOR DOWN HOLE INTERVENTION TOOLS

FIELD OF THE INVENTION

The invention relates to a device, a method and the use of a device for positioning a tool in a well tubular. The device comprising a housing having jacking arm assemblies with extendable jacking arms for fixating the device inside the well tubular. The device further comprises a tool connected to the housing.

BACKGROUND OF THE INVENTION

When constructing a well for oil and gas production a well tubular is introduced into a drilled well. To optimize production it is sometimes necessary to perform operations affecting an annular space surrounding the well tubular by e.g. injecting substances.

A common way to do this is to create a perforation in the well tubular and subsequently injecting a substance. The task of creating a perforation and injecting a substance is however not trivial. It often requires multiple time consuming operations to be carried out inside the well. First the well has to be sealed below the perforation area. Secondly a device for creating the perforation is deployed. Thirdly a device for injecting a substance through the perforation is lowered into the well and fourthly the established seal has to be removed for the well to be operable.

U.S. Pat. No. 6,915,853 discloses a device for drilling horizontal holes in an oil well. The device comprises holding means for positioning the device in the well and drilling means radially extendable for perforating the well casing. When the device is positioned in the well the drilling means can be radially extended by activating a lever initiating the drilling operation.

U.S. Pat. No. 6,772,839 discloses a device for piercing a well tubular and injecting a substance through the piercing member into an annular space. The device comprises a tool body suitable for being arranged in a well tubular, a perforating assembly and a setting-off assembly for positioning the device in a well tubular. The device further comprises a fluid connection to the surface of the well for supplying a substance to be injected through the device.

When performing operations inside a well tubular it can be difficult to control the angular orientation of a device operating inside the well. The angular orientation is of special interest when performing perforation operations as this can greatly affect the quality of the result. If the angle of perforation is not controlled to a certain extend, the well tubular might not be perforated by the perforating means such as a drill. A need therefore exists, for being able to control the angle of e.g. a drill used for perforating a well tubular.

SUMMARY OF THE INVENTION

Disclosed herein is a device for positioning a tool in a well tubular. This is achieved by the device comprising a bellow assembly having inflatable means for positioning the device substantially in the centre of the well tubular; and that the jacking arms are configured for moving the device from a centralized position in the well tubular towards a side wall of the well tubular, whereby activation of the jacking arms pushes the device in a direction which is substantially perpendicular to the well tubular.

Disclosed herein is further the use of the device for performing operations inside a well tubular and for injecting a fluid or fluid mixture through a perforation in the surface of the well tubular.

Disclosed is also a method for positioning the device inside a well tubular. This is achieved by the method comprising the steps of inserting the device inside the well tubular; inflating the inflatable means to centralize the device inside the well tubular and simultaneously advancing the jacking arms and deflating the inflated bellows. An advantage in this respect is that the angle of orientation of the device can be controlled. Thereby operations requiring a specific angle can be performed.

In one embodiment of the invention a device is provided that comprises two or more bellow assemblies. This way the position of a section of the device can be controlled and possible torque created by the later deployment of the jacking arms may be avoided.

In another embodiment of the invention a device is provided wherein the tool is a tool for penetrating a well tubular and injecting a fluid or fluid mixture into an annular space or formation surrounding the well tubular. The tool comprises grooves for injecting a fluid or fluid mixture into the annular space or formation, and the device comprises a fluid supply connected to the grooves such that a fluid can flow from the device and into the annular space via the grooves, while the tool extends through the well tubular. In still another embodiment of the invention a device is provided wherein the tool is a drill bit having helical grooves and a drill packer is mounted around the drill bit. The fluid supply for supplying a fluid or fluid mixture is connected to the grooves such that said fluid can flow from the device and into the annular space via the grooves, while the drill bit extends through the well tubular. By using a tool for creating perforations in a well tubular connected to the device the angle of the perforation can be control. This may increase the quality of the result and the likelihood of penetrating the well tubular.

In another embodiment of the invention a method is provided, comprising the step extending the tool in a radial direction to penetrate the well tubular. By extending the tool from the housing the tool can initial be protected inside the housing.

In still another embodiment of the invention a method is provided, comprising the step of injecting a fluid or fluid mixture from the device, through the grooves of the tool penetrating the well tubular and into an annular space surrounding the well tubular. The use of the grooves for injection purposes can reduce the number of devices and operations necessary to perform down hole intervention.

In still another embodiment of the invention a method is provided, wherein said tool penetrating said well tubular is retracted after having penetrated said well tubular.

Other embodiments of the invention are recited in the dependent claims 5-12.

BRIEF DESCRIPTION OF THE DRAWINGS

In the following, the invention will be described in greater detail with reference to embodiments shown by the enclosed figures. It should be emphasized that the embodiments shown are used for example purposes only and should not be used to limit the scope of the invention.

FIG. 4*a* shows the drill bit assembly in an intermediate position where the drill bit has penetrated the well tubular.

FIG. 4*b* shows the drill bit assembly in an intermediate position where the drill seal is touching the inner surface of the well tubular.

FIG. 4*c* shows the drill bit assembly in the most extended position where the drill seal is pressed against the inner surface of the well tubular.

It should be emphasized that the term "comprises/comprising/comprised of" when used in this specification is taken to specify the presence of stated features, integers, steps or components but does not preclude the presence or addition of one or more other features, integers, steps, components or groups thereof.

DETAILED DESCRIPTION OF THE EMBODIMENTS

Figure 1:
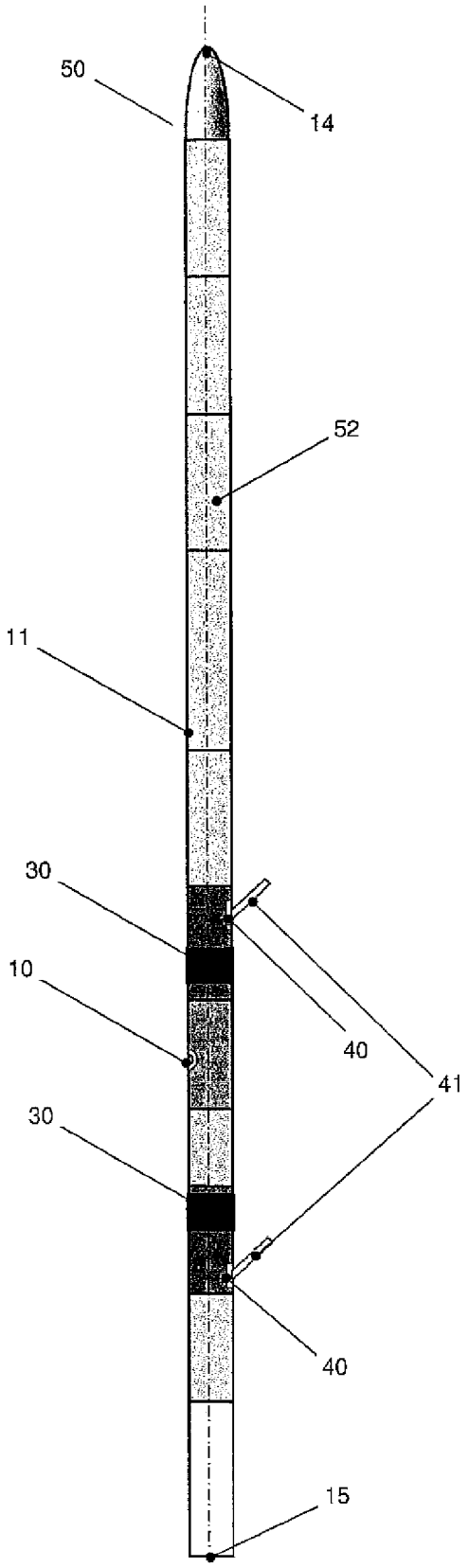
FIG. 1 shows a schematic drawing of one embodiment of the device, with the jacking arms in an extended position.

With reference to FIG. 1 there is shown one embodiment of a device (50) suitable for operating inside a well. The housing has an elongated tubular structure with a front end (14) and a rear end (15). The housing has a shape fitting inside a well tubular.

Along the tubular structure two jacking assemblies (40) for fixating the device inside a well tubular are positioned. The jacking assemblies (40) are arranged at a distance from each other making room for two bellow assemblies (30) and a penetrating assembly (10). The bellow assemblies comprise inflatable rubber bellows. Between the bellow assemblies (30) a penetrating assembly (10) having means for penetrating and subsequently injecting a substance through the well tubular is arranged. In the shown embodiment the bellow assemblies (30) and the jacking assemblies (40) are positioned symmetrically around the penetrating assembly (10). The jacking assemblies (40) are positioned such that the jacking arms (41) can be extended substantially perpendicular to the surface of the housing (51). Further, the jacking arms (41) are positioned opposite the penetrating assembly (10). The penetrating assembly (10) is positioned in a way allowing the penetrating means to extend in a direction parallel to the jacking arms (41) and substantially perpendicular to the surface of the housing (51). Fluid containers (52) containing a fluid or fluid mixture are positioned inside the housing towards the front end (14).

Figure 2:
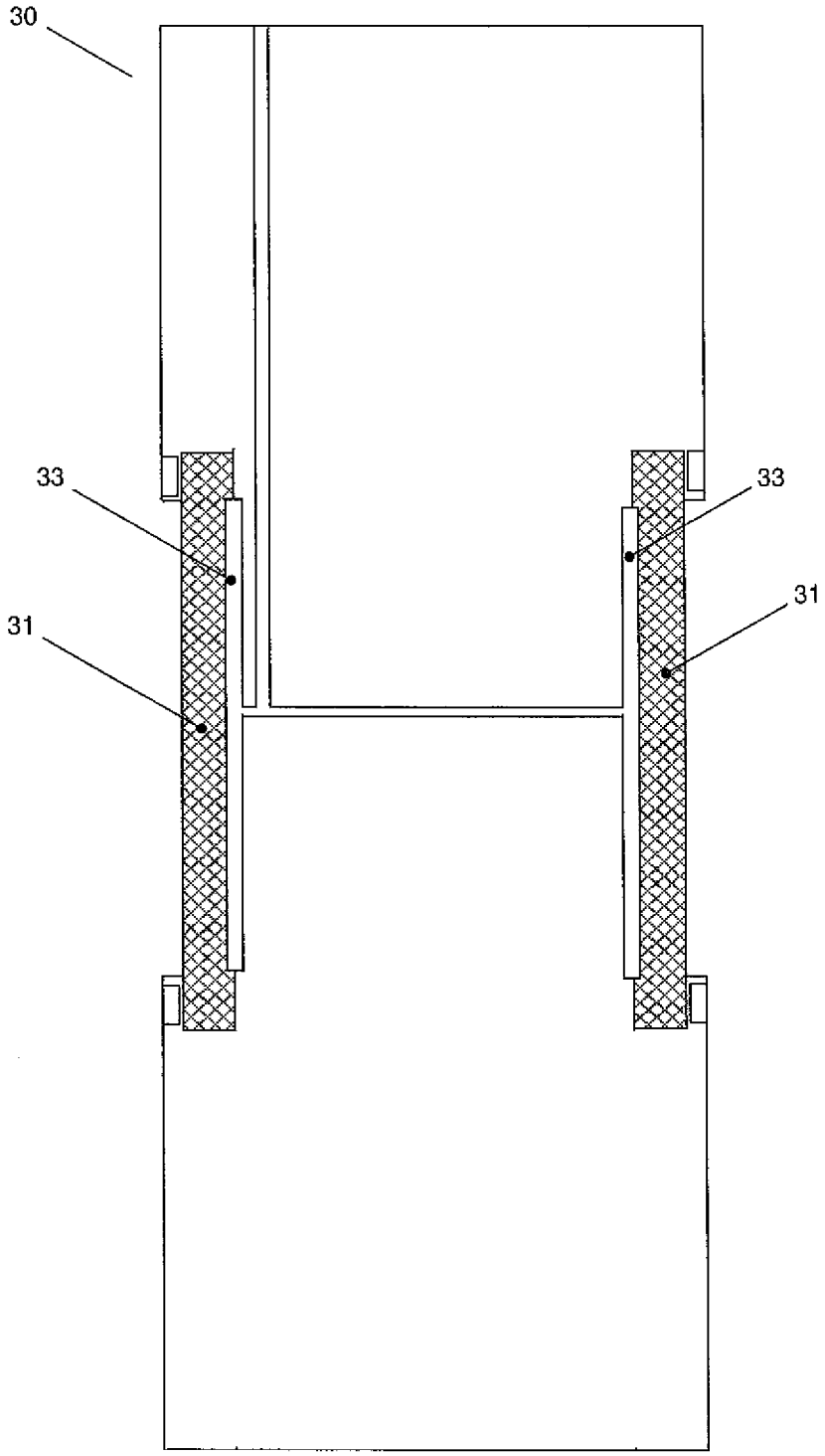
FIG. 2 shows the bellow assembly in principle.

With reference to FIG. 2 there is shown one embodiment of a bellow assembly (30) according to the invention. The bellow assembly comprises inflatable means (31), which in the shown embodiment is in the form of a sleeve (31). In another embodiment according to the invention the inflatable means could be e.g. inflatable cushions distributed along the periphery of the housing (11). In the shown embodiment the bellow assembly further comprises a fluid chamber (33) positioned beneath the sleeve (31); and means for inflating and deflating (not show) the sleeve (31). The sleeve (31) could be made of a material such as but not limited to reinforced rubber and is clamped onto the device (50). The sleeve (31) extends along the periphery of the device all the way around to form an inflatable bellow. The sleeve (31) is designed for being inflated inside a well tubular. When inflated, the sleeve (31) positions the device (50) in the centre of the well tubular no matter what the orientation of the device (50) inside the well tubular is. The sleeve (31) is hydraulic inflated by supplying a fluid to the fluid chamber (33). Supplying liquid to the chamber will create a sufficient pressure to inflate the sleeve (31) and force the device (50) to the centre of the well tubular. The step of centralizing the device (50) prevents the possible working-up of torque in the device during deployment of the jacking arms in the well. Contrary the inflated sleeve (31) can be deflated in a controlled manner to control the position of the device inside the well tubular. The inflated sleeve (31) is deflated by gradually removing liquid from the fluid chamber (33). This will cause the rubber bellow to decrease in size and enable the device to be moved away from the centre of the well tubular. The deflation of the inflated sleeve (31) is coupled to the deployment of the jacking arms in the well.

Figure 3:
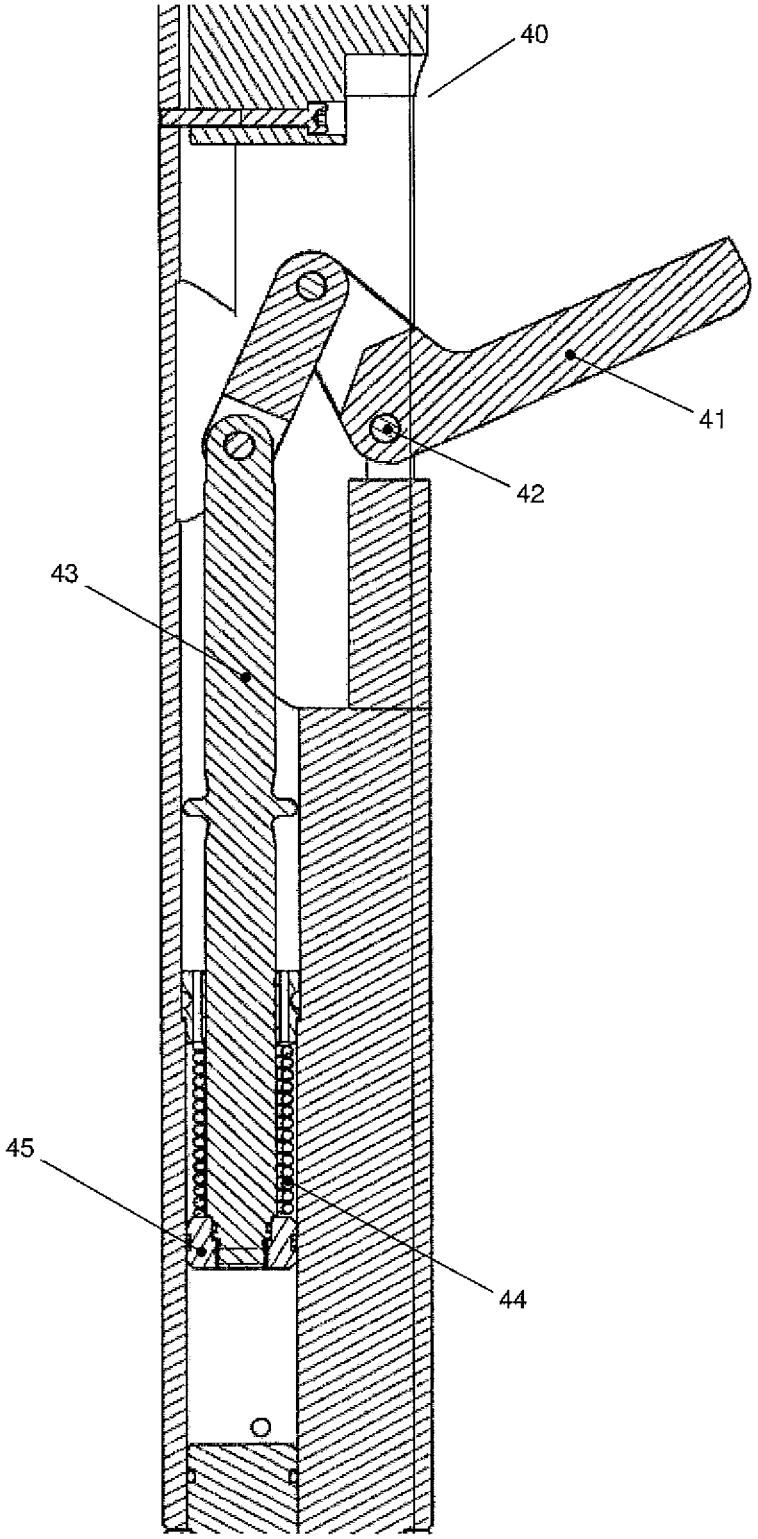
FIG. 3 is a cross sectional view of a part of the device in a longitudinal direction showing details of the jacking assembly.

With reference to FIG. 3 there is shown one embodiment of a jacking assembly (40) comprising a jacking arm (41) connected by a linkage mechanism (43) to a hydraulic piston (44) under the influence of a coiled spring (44). The jacking arm (41) is pivotally mounted at a pivot point (42). In FIG. 3 the jacking arm is in an extended position, the piston (45) is pushed forward and the spring (44) has been compressed. The piston is hydraulically operated by means known to the person skilled in the art and will therefore not be described any further. When pressure on the piston is reduced the forces of the spring will cause the piston to retract. By retracting the piston the linkage mechanism (43) causes the jacking arm to rotate around the pivot point (42) in a counter clockwise direction. When the piston is fully retracted the jacking arm is aligned with the housing (11) and no longer affecting the position of the device (50) inside the well tubular. The jacking arm (41) can subsequently be extended from the housing by applying pressure to the hydraulic operated piston (45). This will cause the jacking arm (41) to move in a clock wise direction affecting the position of the device (50) inside the well tubular.

Figure 4A:
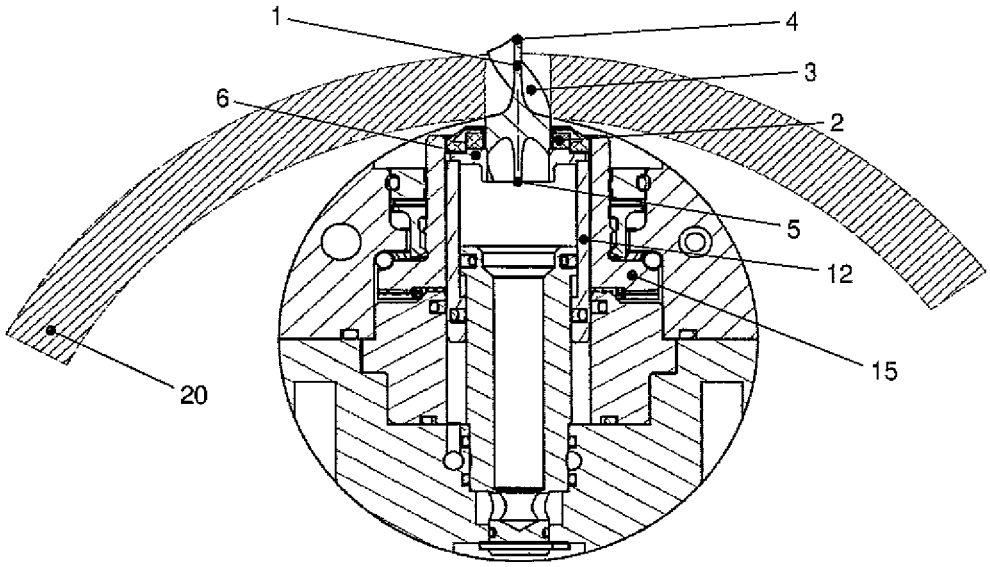
FIG. 4*a-c* is a cross section A-A of the device shown in FIG. 6.
Figure 4B:
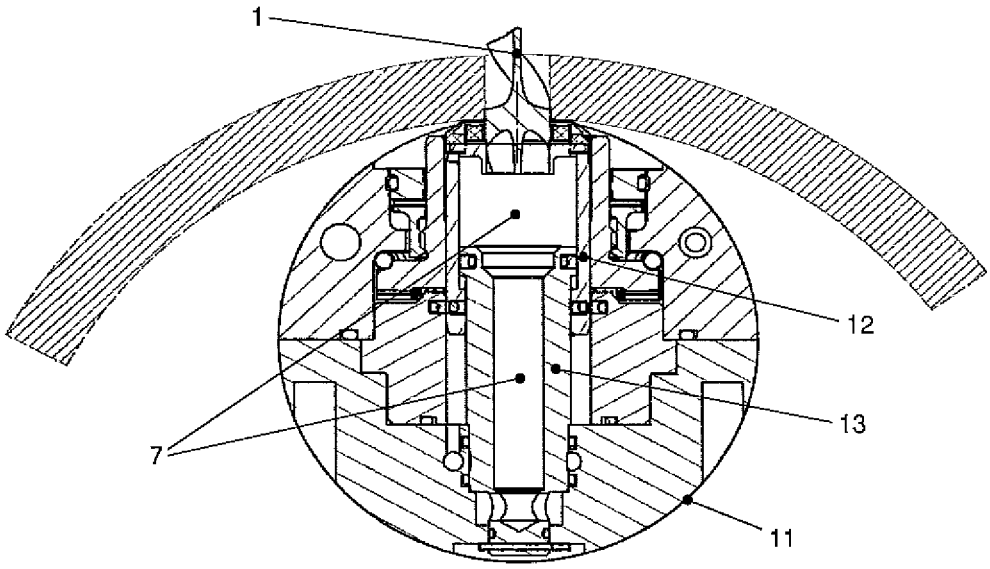
Figure 4C:
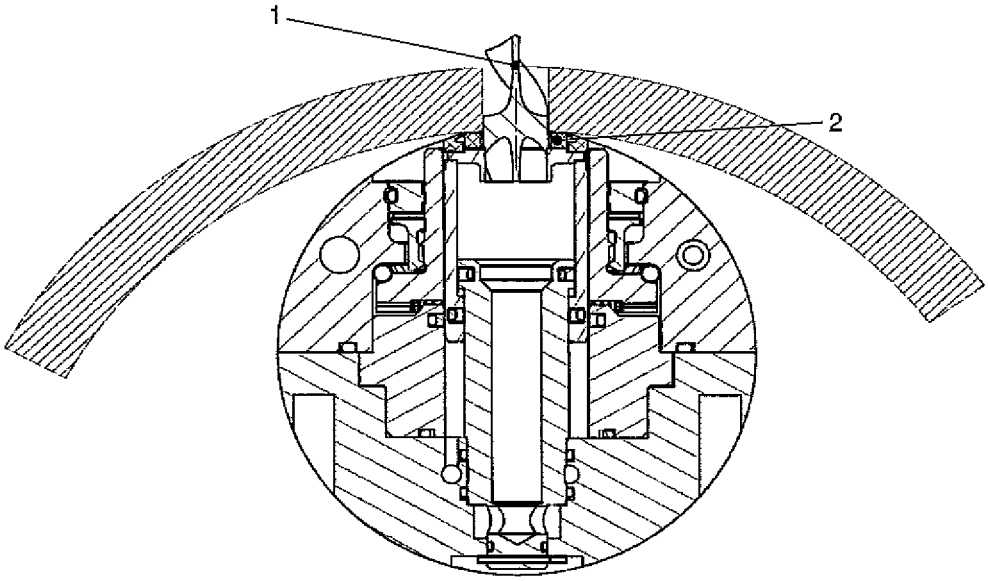
Figure 5:
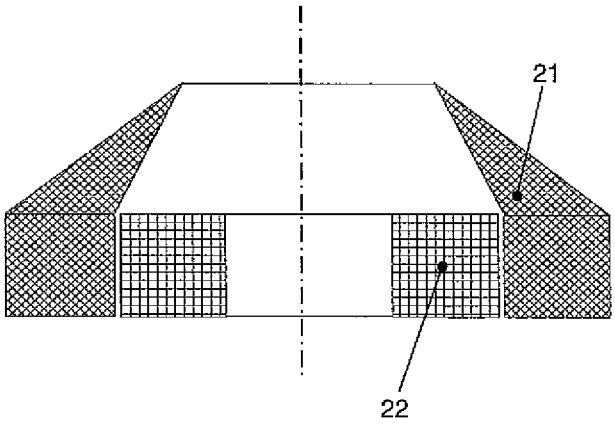
FIG. 5 is a schematic drawing of one embodiment of the drill seal.
Figure 6:
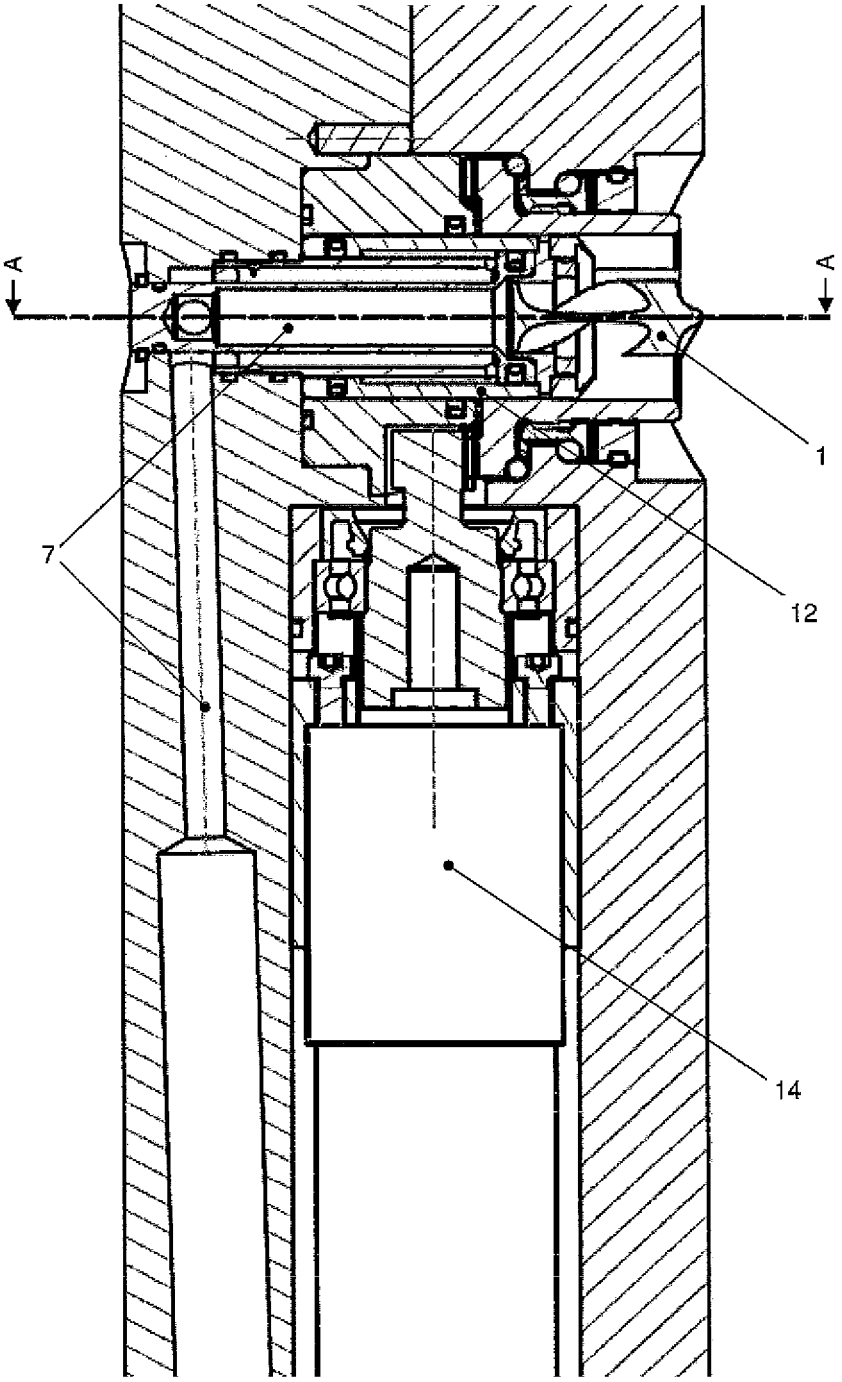
FIG. 6 is a cross sectional view of a part of the device in a longitudinal direction.
Figure 7:
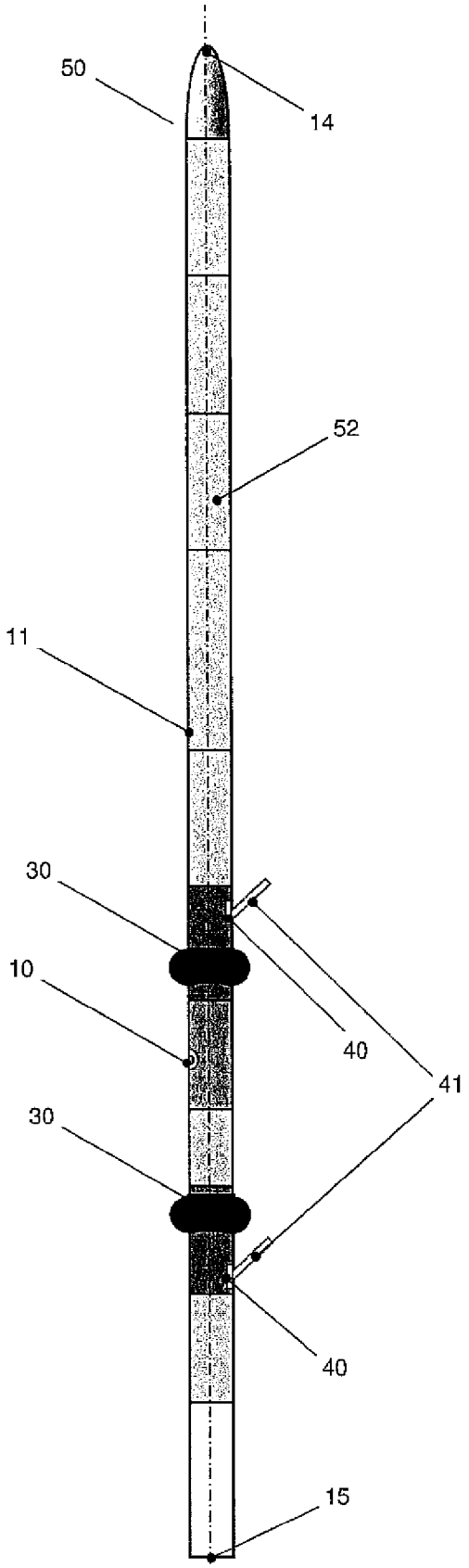
FIG. 7 shows a schematic drawing of one embodiment of the device, with inflated bellows and the jacking arms in an extended position.

With reference to FIG. 4-6 there is shown one embodiment of the penetrating assembly (10). The penetrating assembly according to the present invention could comprise various tools for penetrating the well tubular such as but not limited to a drill bit. In the shown embodiment the penetrating assembly comprises a drill bit (1) and is therefore termed a drill bit assembly. The term drill bit assembly is used through the remainder of the description.

The drill bit assembly (10) is arranged in the housing (11) and connected to drive means, rotation means (14) and a fluid supply for supplying a fluid or fluid mixture.

The drill bit assembly comprises a drill sleeve (12) in the form of a tubular element with a top plate (6), a drill bit (1) and a drill seal (2). The drill bit (1) and the drill seal (2) are mounted to the top plate (6). The drill seal (2) is arranged around the drill bit (1) at the base of the drill bit (1). The base of the drill bit (1) should be understood as the position where the drill bit (1) intersects the top plate (6). The drill bit (1) has a conical shaped front end (4) and a back end (5) penetrating the top plate (6). Helical grooves (3) are extending along the outside surface of the drill bit (1) from the front end (4) to the back end (5). Further the drill bit (1) has cutting edges at the front end (4) and along the helical grooves (3). The drill bit (1) could be interpreted as a twist drill.

The rotating means (14) are connected to the drill sleeve (12) of the drill bit assembly by means of a gear (15) e.g. a spur wheel/gear. When activated, the rotation means (14) rotate the drill sleeve (12) causing the drill bit (1) and drill seal (2) to rotate. The rotation means could e.g. be an electro motor, hydraulics or other means known to a person skilled in the art.

The drill bit (1) is mounted on the top plate (6) in such a manner, that the grooves (3) extending all the way to the back end (5) of the drill bit (1) is accessible from the back end (5). Depending on the stage of operation the grooves (3) are either drilling grooves for removing drilling residue or injection grooves for injecting a fluid or fluid mixture.

The drill bit assembly can be radially advanced from a retracted position inside the housing (11) as shown in FIG. 3 to an extended position as shown in FIG. 1*c*. When necessary the drill bit assembly can be retracted to a position inside the housing (11). The radial movement of the drill bit assembly can be obtained by various drive means e.g. hydraulic pressure, mechanically or other means known to a person skilled in the art. In one embodiment the drill bit assembly is moved by supplying hydraulic pressure to the drill sleeve (12). By applying pressure to and advancing the drill bit assembly drilling operations can be carried out. During drilling operations drilling residue can escape from the drill bit (1) through the drilling grooves (3).

The size of the drilling residue is among others determined by a combination of the drill bit design, the amount of pressure supplied on the drill bit (1) and the revolution speed. To achieve a satisfactory drilling result the drill bit (1) has special machined cutting edges and a special cutting angle.

When the drill bit (1) has drilled all the way through the well tubular (20) a fluid tight seal is created by advancing the drill bit assembly further, there by pressing the drill seal (2) against the well tubular (20).

Referring to FIG. 5 there is shown a schematic drawing of one embodiment of the drill seal (2) comprising an outer ring (21) e.g. a lip seal and an inner ring (22) e.g. an x-seal. When the drill seal (2) is pressed against the inner surface of the well tubular (20) and fluid pressure builds up inside the outer ring (21) a fluid tight seal is created between the drill seal (2) and the inner surface of the well tubular (20). The drill seal (2) has a self-reinforcing effect, in that the pressure of the fluid will amplify the sealing mechanism. The excess pressure exerted on the inner faces of the drill seal (2) will amplify the sealing effect. The established seal creates a fluid connection extending from the back end (5) of the drill bit (1), through the injection grooves (3) and into an annular space or even under special circumstances into the formation surrounding the well.

With the drill bit assembly in its most extended position and the drill seal (2) pushed against the well tubular (20) injection operations can be carried out. By supplying a fluid or fluid mixture to the back end (5) of the drill bit (1), a fluid or fluid mixture can be injected through the injection grooves (3) into an annulus of the well or into the formation. The fluid or fluid mixture such as amongst others epoxy is supplied from one or more containers inside the housing (11), through the feed channel (7) to the injection grooves (3). In one embodiment the device has different containers containing different fluids or fluid mixtures. Inside the feed channel (7), means for mixing (not shown) the supplied fluids are arranged. This could e.g. be a static mixer that by affecting the flow path causes the fluids to be mixed.

Pressure from the injected fluid or fluid mixture will remove drilling residue that could have built up in the grooves during drilling operations. In case the injection grooves are clogged during injection the drill bit can be rotated to remove blocking material.

The part of the feed channel (7) connected to the back end (5) of the drill bit (1) is extended as the drill bit (1) moves in a radial direction. This is accomplished by the drill sleeve (12) moving relatively to the feed channel sleeve (13). As the drill bit (1) moves toward the extended position the overlap between the drill sleeve (12) and the feed channel sleeve (13) is gradually reduced, increasing the total length of the feed channel.

To control the position of the drill bit (1) a sensor system is incorporated in the device (50). The sensor system is used to avoid damaging the drill seal (2) by simultaneously rotating and pressing it against the inner surface of the well tubular (20). When the drill bit (1) has penetrated the well tubular (20), the rotation of the drill bit assembly is stopped at a predetermined position. The drill bit assembly is then advanced and the drill seal (20) is pressed against the inner surface of the well tubular (20) to engage in a fluid tight seal with the well tubular (20).

In one embodiment the sensor system is a magnetic sensor system comprising a magnet (not shown) rigidly connected to the drill sleeve (12) and a sensor (not shown) arranged inside the housing (11) for detecting the exact position of the drill bit (1) in a radial direction. It would however be obvious to a person skilled in the art, that the above described sensor system could be created in many different ways.

Use of the Invention

After the description of the device, its use and operation is specified in further detail.

The device (50) is inserted into a well tubular by conventional means such as a coiled tubing, drill string or the like known to a person skilled in the art, and will therefore not be described in any further detail. Once the device is at the position under consideration the inflatable rubber bellows (31) are inflated as described earlier. This way the device is moved to the centre of the well tubular and the possible working-up of torque in the device during deployment of the jacking arms may be prevented. The inflatable rubber bellows exert a force sufficient to centralize the device.

After the device has been centralized the jacking arms (41) are deployed. The jacking arms (41) are extended from the housing (11) by means described earlier. By simultaneously deflating the sleeves (31) and extending the jacking arms (41) the device is moved towards one side of the well tubular (20) in a controlled manner. By having a system combining inflatable rubber bellows (31) and extendable jacking arms the angular orientation of the device can be controlled better than in the prior art known hereto. When the housing (11) is pressed against the inner surface of the well tubular (20), the longitudinal direction of the drill bit (1) is positioned in a direction substantially perpendicular to the inner surface of the well tubular (20). This secures a drilling angle substantially perpendicular to the surface of the well tubular when the drill bit (1) drills through the well tubular.

The jacking arms (41) fixate the device inside the well tubular during drilling and injection operations. Thereby the means for driving the drill bit assembly is capable of supplying the weight on the drill bit necessary for drilling. When the device is pressed against the surface of the well tubular drilling operations can be commenced by moving the drill bit assembly in a radial direction towards the inner surface of the well tubular (20). By rotating and gradually advancing the drill bit, the cutting edge of the drill bit is capable of drilling through the well tubular (20). When the drill bit has cut all the way through the well tubular (20), the drill seal (2) is pressed against the inner surface of the well tubular (20) by further advancing the drill bit assembly. The fluid tight flow passage created through the injection channels (3) of the drill bit (1) can thus be used for injecting a fluid or fluid mixture into an annular space. With the drill bit (1) penetrating the well tubular, a fluid or fluid mixture can be injected from the containers inside the housing (11) and into an annular space or formation surrounding the well tubular. In case a fluid or fluid mixture such as epoxy is supplied under pressure to the back end (5) of the drill bit (1), the fluid or fluid mixture will flow through the injection grooves (3) and into an annular space surrounding the well.

After the fluid or fluid mixture has been injected the drill bit (1) is retracted to a position inside the housing (11) as shown in FIG. 3. The jacking arms (41) are retracted and the device is no longer fixated inside the well tubular. The device can then be moved to perform operations in a different position or pulled out of the well and prepared for subsequent redeployment.

The use of the above described drilling device is not limited to a well tubular. The drilling device could also be used in other tubular structures such as but not limited to piping systems, sewage pipes, water pipes, waste pipes, downpipes, ventilation shafts, chimneys, wind turbine towers, tunnels or narrow shafts.

It is to be noted that the figures and the above description have shown the example embodiments in a simple and schematic manner. The internal electronics and mechanical details have not been shown since a person skilled in the art should be familiar with these details and they would just unnecessarily complicate this description.

In a one embodiment a device for drilling a hole in a well tubular and for subsequent injection of a fluid or fluid mixture into an annular space or formation surrounding the well tubular, the device comprising: a housing; a drill bit assembly arranged inside the housing, the drill bit assembly comprising: a drill bit having a cutting edge or cutting edges and grooves extending along its outside surface; the device further comprising rotation means connected to the drill bit assembly, the rotation means being capable of rotating the drill bit assembly; a fluid supply for supplying a fluid or fluid mixture to the grooves of the rotating drill bit; a drill seal surrounding the drill bit, for sealing the device against the well tubular; and drive means for advancing the drill bit assembly towards the well tubular. In a second embodiment a device according to one embodiment, wherein the grooves extending along the outside surface of the drill bit are helical grooves. In a third embodiment a device according to any one of the preceding embodiments, wherein the fluid supply for supplying a fluid or fluid mixture to the grooves are fluidly connected to a container inside the housing, the container being suitable for containing a fluid or fluid mixture. In a fourth embodiment a device according to any one of the preceding embodiments, wherein the fluid supply for supplying a fluid or fluid mixture to the grooves are fluidly connected to containers inside the housing, the containers being suitable for containing different fluids or fluid mixtures. In a fifth embodiment a device according to any one of the preceding embodiments, wherein the fluid supply for supplying a fluid or fluid mixture to the grooves are connected to the end of the drill bit opposite the cutting edge, such that fluid can be transported from the device and into an annular space via the grooves, while the drill bit extends through the well tubular. In a sixth embodiment a device according to any one of the preceding embodiments, wherein the drill bit is movable relatively to the drill seal. In a seventh embodiment a device according to any one of the preceding embodiments, wherein the drive means are adapted for being able to retracting the drill bit assembly. In an eighth embodiment a device according to any one of the preceding embodiments, wherein the pressure of the injected fluid will amplify the sealing effect of the drill seal on injection of the fluid or fluid mixture. In a ninth embodiment a device according to any one of the preceding embodiments, wherein the drill seal has converging inner faces. In a tenth embodiment a device according to any one of the preceding embodiments, comprising a sensor for determining the position of the drill bit in a radial direction. In an eleventh embodiment a device according to embodiment ten, wherein the sensor is a magnetic sensor comprising a magnet rigidly mounted to the sleeve and a sensor arranged inside the housing for detecting the position of the magnet. In a twelfth embodiment a device according to any one of the preceding embodiments, wherein the drill bit assembly comprises a rotatable drill sleeve connected to the drill bit and to the drive means. In a thirteenth embodiment a device according to embodiment twelve, wherein the drill sleeve is connected to the rotation means. In a fourteenth embodiment a device according to embodiment thirteen, wherein the drill seal is mounted on the drill sleeve. In a fifteenth embodiment a device according to embodiment eight, wherein the drill seal is mounted onto the housing. In a sixteenth embodiment a device according to any one of the preceding embodiments, comprising means for pressing the device against the inner surface of the well tubular. In one embodiment a drill bit according to any one of the preceding embodiments, the drill bit having cutting edges and grooves extending along its outside surface, the drill bit further having a peripheral mounted drill seal. In one embodiment the use of a device according to any one of the preceding embodiments, for performing operations inside a well tubular. In a other embodiment the use of a device according to the previous embodiment, for injecting a fluid or fluid mixture through a perforation in the surface of a well tubular.

The invention claimed is:

1. A device for positioning a tool in a well tubular, said device comprising:

(a) a housing, wherein the tool is connected to said housing;

(b) jacking arm assemblies arranged inside said housing, said jacking arm assemblies comprising jacking arms extendable from said housing for fixating said device inside said well tubular; and (c) a bellow assembly arranged on the housing comprising a portion configured to inflate to facilitate positioning said device substantially in the center of said well tubular, wherein said jacking arms are configured to move said device from a centralized position in said well tubular towards a side wall of said well tubular, whereby activation of said jacking arms pushes said device in a direction which is substantially perpendicular to a longitudinal axis of said well tubular, wherein when said jacking arms extends from said housing, said portion of said bellow is configured to simultaneously deflate, wherein said tool is configured to penetrate said well tubular and inject a fluid or fluid mixture into an annular space or formation surrounding said well tubular, said tool comprising grooves for injecting a fluid or fluid mixture into said annular space or formation, and said device comprising a fluid supply connected to said grooves such that a fluid can flow from said device and into said annular space via said grooves, while said tool extends through said well tubular.

2. The device according to claim 1, wherein said device comprises two or more bellow assemblies.

3. The device according to claim 1, wherein said fluid supply for supplying a fluid or fluid mixture to said grooves are fluidly connected to containers inside said housing, said containers being suitable for containing different fluids or fluid mixtures.

4. The device according to claim 1, wherein said jacking arms are extendable from said housing opposite said tool.

5. The device according to claim 1, wherein said tool is extendable in a radial direction.

6. The device according to claim 5, comprising a sensor for determining the position of said tool in a radial direction.

7. The device according to the claim 6, wherein said sensor is a magnetic sensor comprising a magnet rigidly connected to said tool and a sensor arranged inside said housing for detecting the position of said magnet.

8. The device according to claim 1, wherein said bellow assembly corresponds to inflatable sleeves.

9. The device according to claim 1 comprising wherein said portion of said bellow assembly configured to inflate is further configured to deflate.

10. A device for positioning a tool in a well tubular, said device comprising:

(a) a housing;

(b) jacking arm assemblies arranged inside said housing, said jacking arm assemblies comprising jacking arms extendable from said housing for fixating said device inside said well tubular;

(c) a tool connected to said housing; and (d) a bellow assembly arranged on the housing comprising a portion configured to inflate to facilitate positioning said device substantially in the center of said well tubular, wherein said jacking arms are configured to move said device from a centralized position in said well tubular towards a side wall of said well tubular, whereby activation of said jacking arms pushes said device in a direction which is substantially perpendicular to a longitudinal direction of said well tubular, wherein when said jacking arms extends from said housing, said portion of said bellow is configured to simultaneously deflate, wherein said tool is a drill bit having helical grooves, a drill packer is mounted around said drill bit, and said fluid supply for supplying a fluid or fluid mixture is connected to said grooves such that said fluid can flow from said device and into said annular space via said grooves, while said drill bit extends through said well tubular.

11. The device according to the claim 10, wherein said drill bit and said drill packer are mounted on a rotatable drill sleeve and said device comprises means for driving and rotation said drill sleeve.

12. A method for performing an operation in a well tubular, the method comprising:

providing a device that includes:

(a) a housing;

(b) jacking arm assemblies arranged inside said housing, said jacking arm assemblies comprising jacking arms extendable from said housing for fixating said device inside said well tubular;

(c) a tool connected to said housing; and (d) a bellow assembly arranged on the housing comprising a portion configured to inflate to facilitate positioning said device substantially in the center of said well tubular, wherein said jacking arms are configured to move said device from a centralized position in said well tubular towards a side wall of said well tubular, whereby activation of said jacking arms pushes said device in a direction which is substantially perpendicular to a longitudinal axis of said well tubular, wherein when said jacking arms extends from said housing, said portion of said bellow is configured to simultaneously deflate, lowering the device into the well tubular;

performing the operation within the well tubular via the device, perforating the inside surface of the well tubular with the tool; and injecting the fluid or fluid mixture through the perforation.

13. A method for performing an operation inside a well tubular, said method comprising:

providing a device for positioning a tool in a well tubular, the device including:

(a) a housing;

(b) jacking arm assemblies arranged inside said housing, said jacking arm assemblies comprising jacking arms extendable from said housing for fixating said device inside said well tubular;

(c) a tool connected to said housing; and (d) a bellow assembly arranged on the housing comprising a portion configured to inflate to facilitate positioning said device substantially in the center of said well tubular, wherein said jacking arms are configured to move said device from a centralized position in said well tubular towards a side wall of said well tubular, whereby activation of said jacking arms pushes said device in a direction which is substantially perpendicular to a longitudinal direction of said well tubular, wherein when said jacking arms extends from said housing, said portion of said bellow is configured to simultaneously deflate inserting said device inside said well tubular;

inflating said portion of said bellow assembly to centralize said device inside said well tubular; and simultaneously advancing said jacking arms and deflating said portion of said bellow assembly.

14. The method according to claim 13, further comprising extending said tool in a radial direction to penetrate said well tubular.

15. The method according to claim 14, further comprising injecting the fluid or fluid mixture from the device, via grooves of said tool penetrating said well tubular and into an annular space surrounding said well tubular.

16. The method according to claim 14, wherein said tool penetrating said well tubular is retracted after having penetrated said well tubular.

* * * * *